US009888534B2

(12) United States Patent
Hong

(10) Patent No.: US 9,888,534 B2
(45) Date of Patent: Feb. 6, 2018

(54) TRIGGER CIRCUIT, LIGHT APPARATUS COMPRISING THE SAME AND TRIGGER METHOD

(71) Applicant: Magnachip Semiconductor, Ltd., Cheongju-si (KR)

(72) Inventor: Seung Woo Hong, Seoul (KR)

(73) Assignee: Magnachip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 15/210,625

(22) Filed: Jul. 14, 2016

(65) Prior Publication Data

US 2017/0027031 A1 Jan. 26, 2017

(30) Foreign Application Priority Data

Jul. 20, 2015 (KR) ..... 10-2015-0102567

(51) Int. Cl.
*H05B 33/08* (2006.01)
*H05B 37/02* (2006.01)

(52) U.S. Cl.
CPC ..... *H05B 33/0815* (2013.01); *H05B 33/0845* (2013.01); *H05B 37/0281* (2013.01)

(58) Field of Classification Search
CPC combination set(s) only.
See application file for complete search history.

(56) References Cited

U.S. PATENT DOCUMENTS

2010/0165683 A1* 7/2010 Sugawara ..... H02M 1/4225 363/126
2012/0229050 A1* 9/2012 Yu ..... H02M 3/156 315/307

* cited by examiner

*Primary Examiner* — Douglas W Owens
*Assistant Examiner* — Jianzi Chen
(74) *Attorney, Agent, or Firm* — NSIP Law

(57) ABSTRACT

A trigger circuit includes an off-time controller configured to receive a sensing voltage by sensing a driving current and to compare the sensing voltage to first and second certain voltages that are close to a zero voltage value and symmetrical to the zero voltage value to control a turn-off time of a driving switch in order for the sensing voltage to correspond to the zero voltage value at the turn-on time point of the driving switch and a switching controller configured to provide a switching control signal for turning on the driving switch at the turn-on time point of the driving switch.

20 Claims, 6 Drawing Sheets

TRIGGER CIRCUIT, LIGHT APPARATUS COMPRISING THE SAME AND TRIGGER METHOD

CROSS-REFERENCE TO RELATED APPLICATIONS

This application claims the benefit under 35 USC 119(a) of Korean Patent Application No. 10-2015-0102567 filed on Jul. 20, 2015 in the Korean Intellectual Property Office, the entire disclosure of which is incorporated herein by reference for all purposes.

BACKGROUND

1. Field

The following description relates to a driving technique of a trigger circuit. The following description also relates to such a trigger circuit and a light apparatus having such a trigger circuit that are capable of controlling a turn-off time of a driving switching element to provide a boundary conduction mode.

2. Description of Related Art

A power factor correction converter generally operates in a continuous conduction mode and in a boundary conduction mode. The continuous conduction mode may use a fixed frequency of an integrated circuit (IC) to control an inductor current or a driving current. The boundary conduction mode may use a variable frequency to turn on a driving switch when the inductor current reaches a zero value.

A Light Emitting Diode (LED) light apparatus may be driven through a switching converter method. Also, a switching converter may be classified according to a Buck-type, a Boost-type and a Buck-Boost-type. A Buck-type converter is a DC-to-DC power converter which steps down voltage while stepping up current from its input to its output. A Boost-type converter is a DC-to-DC power converter which steps up voltage while stepping down current from its input to its output. A Buck-Boost-type converter is a converter that is able to operate as either a Buck-type converter or a Boost-type converter. Previously, the switching converter of the Boost-type was most commonly used, but more recently the Buck-type is used more commonly for a cost reduction of the integrated circuit (IC). In general, a type of the switching converter may be classified according to a ratio of an input voltage and an output voltage, as discussed, and may include a MOSFET in order to provide an average inductor current mode method.

An existing technology may use a drain voltage of the MOSFET for detecting a time point at which the inductor current reaches the zero value. The drain voltage of the MOSFET may rapidly decrease at the time point when the inductor current reaches the zero value, so the integrated circuit (IC) may use an external high breakdown voltage element for detecting the time point when the inductor current reaches the zero value. However, the existing technology uses the high breakdown voltage element, which causes a price competitiveness problem.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a trigger circuit includes an off-time controller configured to receive a sensing voltage by sensing a driving current and to compare the sensing voltage to first and second certain voltages that are close to a zero voltage value and symmetric to the zero voltage value to control a turn-off time of a driving switch in order for the sensing voltage to correspond to the zero voltage value at a turn-on time point of the driving switch, and a switching controller configured to provide a switching control signal for turning on the driving switch at the turn-on time point of the driving switch.

The off-time controller may include a first capacitor that is charged or discharged based on the sensing voltage and the first and second certain voltages to control the turn-off time of the driving switch.

The off-time controller may provide a charge switching signal associated with a charge of the first capacitor in response to the sensing voltage being larger than the first certain voltage.

The off-time controller may provide a discharge switching signal associated with a discharge of the first capacitor in response to the sensing voltage being smaller than the second certain voltage.

The off-time controller may provide a leading switching signal associated with a charge of the first capacitor during a certain time from a time point at which the driving switch is turned on.

The off-time controller may discharge the first capacitor using a first constant current during a section in which the sensing voltage is smaller than the second certain voltage.

The off-time controller may charge the first capacitor using a first constant current during a certain time from the time point that the driving switch is turned on in response the sensing voltage being larger than the first certain voltage.

The off-time controller may include a buffer amplifier in order to control an operating section of the sensing voltage.

The off-time controller may compare an output of the buffer amplifier and first and second reference voltages to detect a time point at which the sensing voltage reaches the first and second certain voltages.

The buffer amplifier may be provided using an inverting amplifier or a non-inverting amplifier.

The trigger circuit may further include a sawtooth wave voltage generator configured to charge a second capacitor with a second constant current during a turn-off section of the operation of the driving switch to generate a sawtooth wave voltage applied to both terminals of the second capacitor.

The sawtooth wave voltage generator may initialize the sawtooth wave voltage at the turn-on time point of the driving switch.

The trigger circuit may further include a pulse width controller configured to provide a pulse width control signal at the turn-off time point of the driving switch in order to control a pulse width of a switching control signal for turning on the driving switch.

The switching controller may output the switching control signal in response to the sawtooth wave voltage reaching an off-time control voltage applied to both terminals of the first capacitor.

The first certain voltage may correspond to a positive voltage that is close to the zero voltage value and the second certain voltage may correspond to a negative voltage that is close to the zero voltage value.

The switching controller may include a switching trigger configured to output a switching trigger signal, a storage configured to turn on or turn off the driving switch based on an output variance time point of the switching trigger signal, and a gate driver configured to output the switching control signal for turning on the driving switch.

The storage may be provided using an SR latch.

The gate driver may output the switching control signal through a gate pin.

In another general aspect, a light emitting diode light apparatus includes a light emitting diode (LED) device, an inductor connected in series to the LED device, a driving switch connected in series to the inductor, and a trigger circuit configured to sense a driving current for driving the LED device in order to control a turn-off time of the driving switch, wherein the trigger circuit includes an off-time controller configured to receive a sensing voltage by sensing the driving current and comparing the sensing voltage to first and second certain voltages that are close to a zero voltage value and symmetrical to the zero voltage value to control a turn-off time of the driving switch in order for the sensing voltage to correspond to the zero voltage value at a turn-on time point of the driving switch, and a switching controller configured to provide a switching control signal in order to turn on the driving switch at the turn-on time point of the driving switch.

In another general aspect, a trigger method includes receiving a sensing voltage by sensing a driving current and comparing the sensing voltage to first and second certain voltages that are close to a zero voltage value and symmetrical to the zero voltage value to charge or discharge a first capacitor, comparing an off-time control voltage applied to both terminals of the first capacitor to a sawtooth wave voltage applied to both terminals of a second capacitor, and turning on the driving switching element in response to the sawtooth wave voltage reaching the off-time control voltage.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
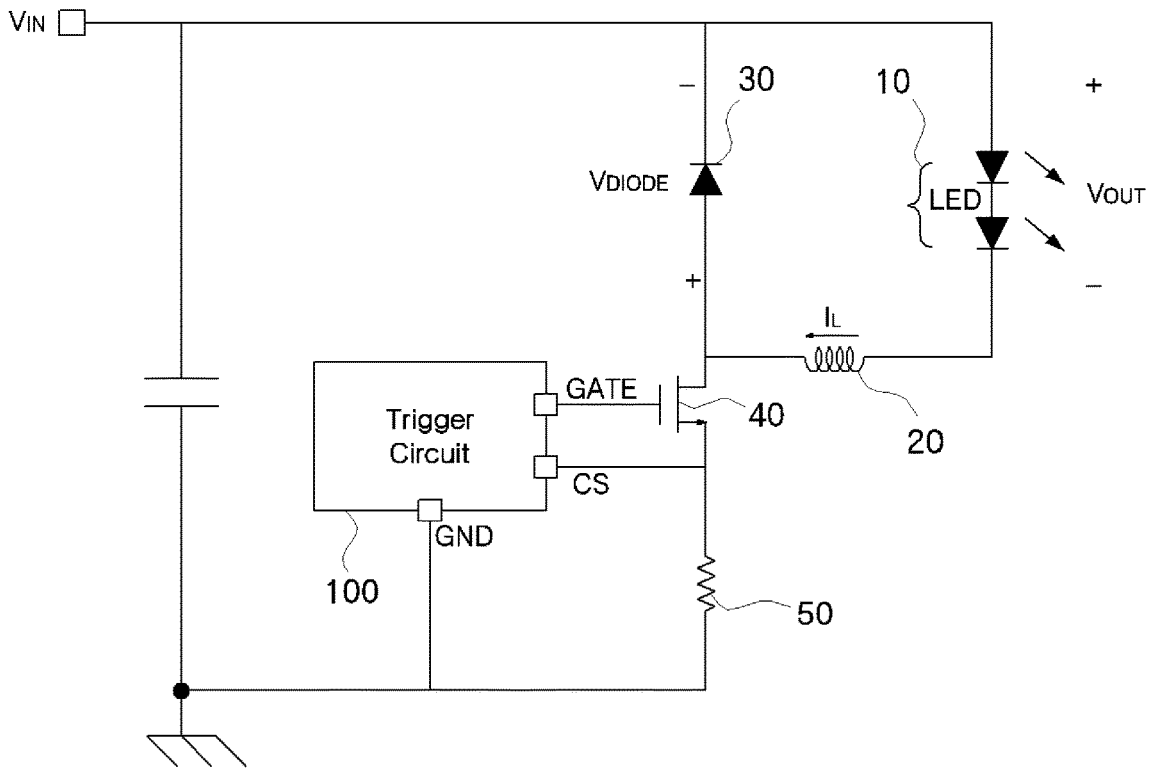
FIG. 1 is a circuit diagram illustrating a trigger circuit and a light apparatus having the same, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

While terms such as "first," "second," and the like, may be used to describe various components, such components are not to be understood as being limited to the terms. The terms are merely used to help the reader to distinguish one component from another.

It is to be understood that when an element is referred to as being "connected to" or "connected with" another element, the element is possibly directly connected to the other element or intervening elements may also be present. In contrast, when an element is referred to as being "directly connected to" another element, no intervening elements are present, except where the context makes it clear that other intervening elements may be present. In addition, unless explicitly described to the contrary, the word "comprise" and variations such as "comprises" or "comprising," or synonyms such as "including" or "having," are to be understood to imply the inclusion of stated elements but not the exclusion of any other elements. Meanwhile, other expressions describing relationships between components such as "between", "immediately between" or "adjacent to" and "directly adjacent to" may be construed similarly.

Singular forms "a", "an" and "the" in the present disclosure are intended to include the plural forms as well, unless the context clearly indicates otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it is to be readily apparent that more than one device or article may be used in place of a single device or article. Similarly, where more than one device or article is described herein, it is to be readily apparent that a single device or article may be used in place of the more than one device or article. The functionality or the features of a device may be alternatively embodied by one or more other devices that are not explicitly described as having such functionality or features.

According to one embodiment, a trigger circuit, a light apparatus having the trigger circuit, and a trigger method may not use an external high breakdown voltage element to control a turn-off time of a driving switching element.

According to one embodiment, a trigger circuit, a light apparatus having the trigger circuit, and a trigger method may control a turn-off time of a driving switch in order for a driving current to correspond a zero current at a turn-on time point of a driving switch.

According to one embodiment, a trigger circuit, a light apparatus having the trigger circuit, and a trigger method may not use an external high breakdown voltage device to provide a boundary conduction mode for improving price competitiveness.

FIG. 1 is a circuit diagram illustrating a trigger circuit and a light apparatus having the same according to an embodiment.

Referring to the embodiment of FIG. 1, a light emitting diode light apparatus includes a LED module or LED device 10, an inductor 20, a diode 30, a driving switch 40, a sensing resistance 50 and a trigger circuit 100.

The light emitting diode light apparatus may be provided with an input voltage $V_{IN}$ from an input power supply. In this example, the input power supply corresponds to a source of the input voltage $V_{IN}$. For example, the input voltage $V_{IN}$ may correspond to a DC voltage $V_{DC}$ or an AC voltage $V_{AC}$. In one embodiment, when the input voltage $V_{IN}$ corresponds to the DC voltage $V_{DC}$, the input power supply may provide a stable DC power supply $V_{DC}$. Alternatively, when the input voltage $V_{IN}$ corresponds to the AC voltage $V_{AC}$, a frequency of an AC input voltage $V_{AC}$ may correspond to, but is not necessarily limited to corresponding to, 50 Hz or 60 Hz according to an electric power provider.

In one embodiment, the light emitting diode light apparatus may be driven through using a switching converter method. The light emitting diode light apparatus may optimize an output power through using the switching converter method. For example, the light emitting diode light apparatus may variably control the output power $V_{OUT}$ in order to save the energy and decrease a caloric value of energy consumption. In some embodiment, the light emitting diode light apparatus is provided as a Buck-type converter. However, the light emitting diode light apparatus is not necessarily limited to a Buck-type converter, and it may be provided as a Boost-type converter or a Buck-Boost-type converter.

The LED device 10 may be formed into n, where n is a natural number, groups as a form including a series, parallel and series-parallel connection of each of LED to be disposed. For example, the LED device 10 may be driven by receiving the input voltage $V_{IN}$. Accordingly, the light emitting diode light apparatus may control an output voltage $V_{OUT}$ and a driving current $I_L$ to regulate a brightness of the LED device 10. In this example, the output voltage $V_{OUT}$ corresponds to the voltage applied to both terminals of the LED device 10. For example, the driving current $I_L$ may drive the LED device 10 through the output voltage $V_{OUT}$. Also, the driving current $I_L$ may flow through the driving switch 40 when the driving switch 40 is turned on.

In one embodiment, the driving current $I_L$ may include first and second driving current sections. In such an example, the driving current $I_L$ may generate a ringing in the first driving current section. However the ringing may be removed when the boundary conduction mode is embodied in the second driving current section. Also, the trigger circuit 100 may not use an external high breakdown voltage device to remove the ringing.

In such an embodiment, the inductor 20 may be connected in parallel with the LED device 10. Also, the driving switch 40 may electrically connected to the inductor 20 and the diode 30. For example, the driving switch 40 may be disposed between the inductor 20 and the trigger circuit 100. The driving switch 40 may receive a switching control signal from the trigger circuit 100, so as to be turned on or turned off. When the driving switch 40 is turned on, the driving current $I_L$ may flow into the sensing resistance 50. By contrast, when the driving switch 40 is turned off, a flow of the driving current $I_L$ may be cut off. Therefore, the light emitting diode light apparatus may control the output voltage $V_{OUT}$ and the driving current $I_L$ through using the switching control signal.

In one embodiment, when the driving switch 40 is turned on, the driving current $I_L$ may flow through the driving switch 40 and the inductor 20 may be charged by the driving current $I_L$. However, when the driving switch 40 is turned off, a current charged in the inductor 20 may be discharged so as to flow into the LED device 10 through the diode 30. Accordingly, while the driving switch 40 is turned off, the inductor 20 may operate as a current source of the driving current $I_L$.

In one embodiment, the driving switch 40 may be provided through using a Power MOSFET. When the driving switch 40 is provided through using the Power MOSFET, the switching control signal may be transmitted to a gate terminal of the Power MOSFET through a GATE pin and the switching control signal may control the flow of the driving current $I_L$. For example, the switching control signal may turn on the driving switch 40 in case of receiving a positive value, such as a high level or 1, and may turn off the driving switch 40 in case of a negative value, such as a low level or 0.

In the embodiment of FIG. 1, the sensing resistance 50 may be electrically connected to the driving switch 40 and electrically connected to the trigger circuit 100. In this embodiment, a voltage applied to both terminals of the sensing resistance 50 corresponds to the sensing voltage $V_{CS}$ and the sensing voltage $V_{CS}$ may also be applied to the trigger circuit 100 through a CS pin. That is, the sensing resistance 50 may be connected to a first terminal of the driving switch 40 in order to sense the driving current $I_L$ passing through the driving switch 40.

Figure 2:
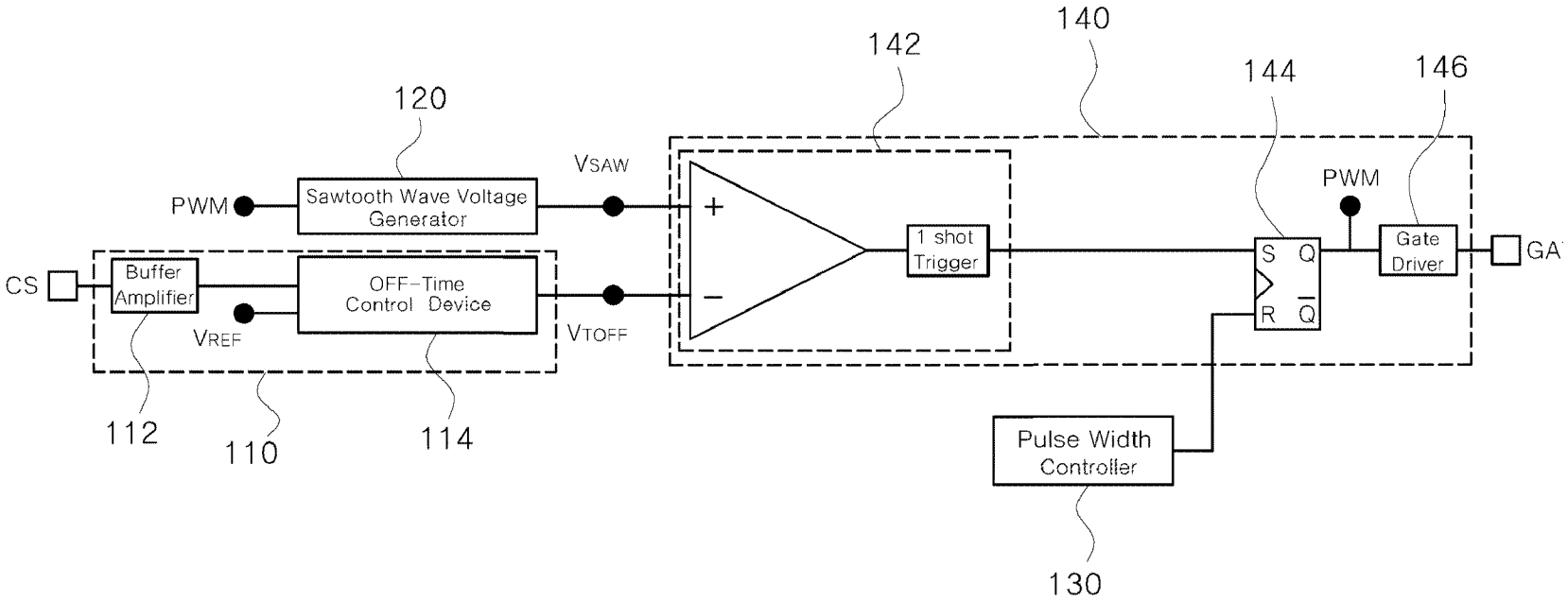
FIG. 2 is a block diagram illustrating a trigger circuit in the embodiment of FIG. 1.

FIG. 2 is a block diagram illustrating a trigger circuit in the embodiment of FIG. 1.

Referring to the example of FIG. 2, the trigger circuit 100 includes an off-time control unit or off-time controller 110, a sawtooth wave voltage generation unit or sawtooth wave voltage generator 120, a pulse width control unit or pulse width controller 130 and a switching control unit or switching controller 140.

The off-time controller 110 may receive the sensing voltage $V_{CS}$ by sensing the driving current $I_L$ and may compare the sensing voltage $V_{CS}$ with first and second certain voltages. In this example, first and second certain voltages may be close to a zero voltage value and may be symmetrical to the zero voltage value. In one embodiment, the first certain voltage may correspond to the positive voltage being close to the zero voltage and the second certain voltage may correspond to the negative voltage being close to the zero voltage. Accordingly, the off-time controller 110 may control the turn-off time of the driving switch 40 in order for the sensing voltage to correspond to the zero voltage value at the turn-on time point of the driving switch 40.

Also, the off-time controller 110 may include a buffer amplifier 112 and an off-time control device 114. Furthermore, the buffer amplifier 112 may receive the sensing voltage $V_{CS}$ through the CS pin. For example, the buffer amplifier 112 may detect the sensing voltage $V_{CS}$ at an operation section of an integrated circuit (IC). In one embodiment, the buffer amplifier 112 may be provided using an inverting amplifier or a non-inverting amplifier.

For example, the off-time control device 114 may compare an output of the buffer amplifier 112 with first and second reference voltages to detect a time point that the sensing voltage reaches the first and second certain voltages. More specifically, the off-time control device 114 may compare the output of the buffer amplifier 112 with first and second reference voltages to generate an off-time control voltage $V_{TOFF}$. The off-time control device 114 may control the off-time control voltage $V_{TOFF}$ in order to control the turn-off time of the driving switch 40.

In the embodiment of FIG. 2, the sawtooth wave voltage generator 120 may generate a sawtooth wave voltage $V_{SAW}$ based on a pulse width modulation (PWM) signal. For example, the sawtooth wave voltage generator 120 may provide the sawtooth wave voltage $V_{SAW}$ to the switching controller 140.

The pulse width controller 130 may provide a pulse width control signal at the turn-off time point of the driving switch 40 for controlling the pulse width of the switching control signal. More specifically, when the driving switch 40 is turned on, the pulse width controller 130 may receive the sensing voltage $V_{CS}$ generated by the driving current $I_L$ passing through the driving switch 40 through the CS pin. For example, the pulse width controller 130 may provide the pulse width control signal at the turn-off time point of the driving switch 40 based on the sensing voltage $V_{CS}$.

For example, the switching controller 140 may include a switching trigger 142, a storage 144 and a gate driver 146. The switching controller 140 may provide the switching control signal to the driving switch 40 through a gate pin at a turn-on time point or a turn-off time point of the driving switch 40. For example, the switching trigger 142 may receive the off-time control voltage $V_{TOFF}$ from the off-time controller 110 and may receive the sawtooth wave voltage $V_{SAW}$ from the sawtooth wave voltage generator 120. Furthermore, the switching trigger module 142 may compare the off-time control voltage $V_{TOFF}$ and the sawtooth wave voltage $V_{SAW}$. When the sawtooth wave voltage $V_{SAW}$ reaches the off-time control voltage $V_{TOFF}$, the switching trigger 142 may output the switching trigger signal for turning on the driving switch 40 and the switching trigger signal may correspond to the edge clock. Also, the switching controller 140 may provide the switching control signal for turning on the driving switch 40 based on the switching trigger signal. Furthermore, the switching controller 140 may provide the switching control signal for turning off the driving switch 40 based on the pulse width control signal.

The storage 144 may be electrically connected to the switching trigger 142 and the pulse width controller 130. Also, the storage 144 may provide the output value for turning on or turning off of the driving switch 40 based on an output variance time point of the switching trigger 142 or the pulse width controller 130.

For example, the gate driver 146 may receive the output value of the storage 144 to output the switching control signal. The switching control signal may be provided to the driving switch 40 through the gate pin. In one embodiment, the gate driver 146 may amplify the output of the storage 144 up to a voltage that is required for the turning-on or turning-off of the driving switch 40 and may output the switching control signal at a low impedance. Accordingly, the gate driver 146 may rapidly provide the switching control signal to the driving switch 40 based on the output value variance of the storage 144.

In one embodiment, the storage 144 may be provided using a SR latch. For example, when the storage 144 receives the positive value, such as high level or 1, from the switching trigger 142 to transmit into the S terminal, the storage 144 may output the positive value, such as high level or 1, for turning on the driving switch 40. However, when the storage 144 receives the positive value, such as high level or 1, from the pulse width controller 130 to transmit into the R terminal, the storage 144 may output the negative value, such as low level or 1, for turning off the driving switch 40. That is, the gate driver 146 may output the switching control signal based on the output value of the storage 144.

Figure 3:
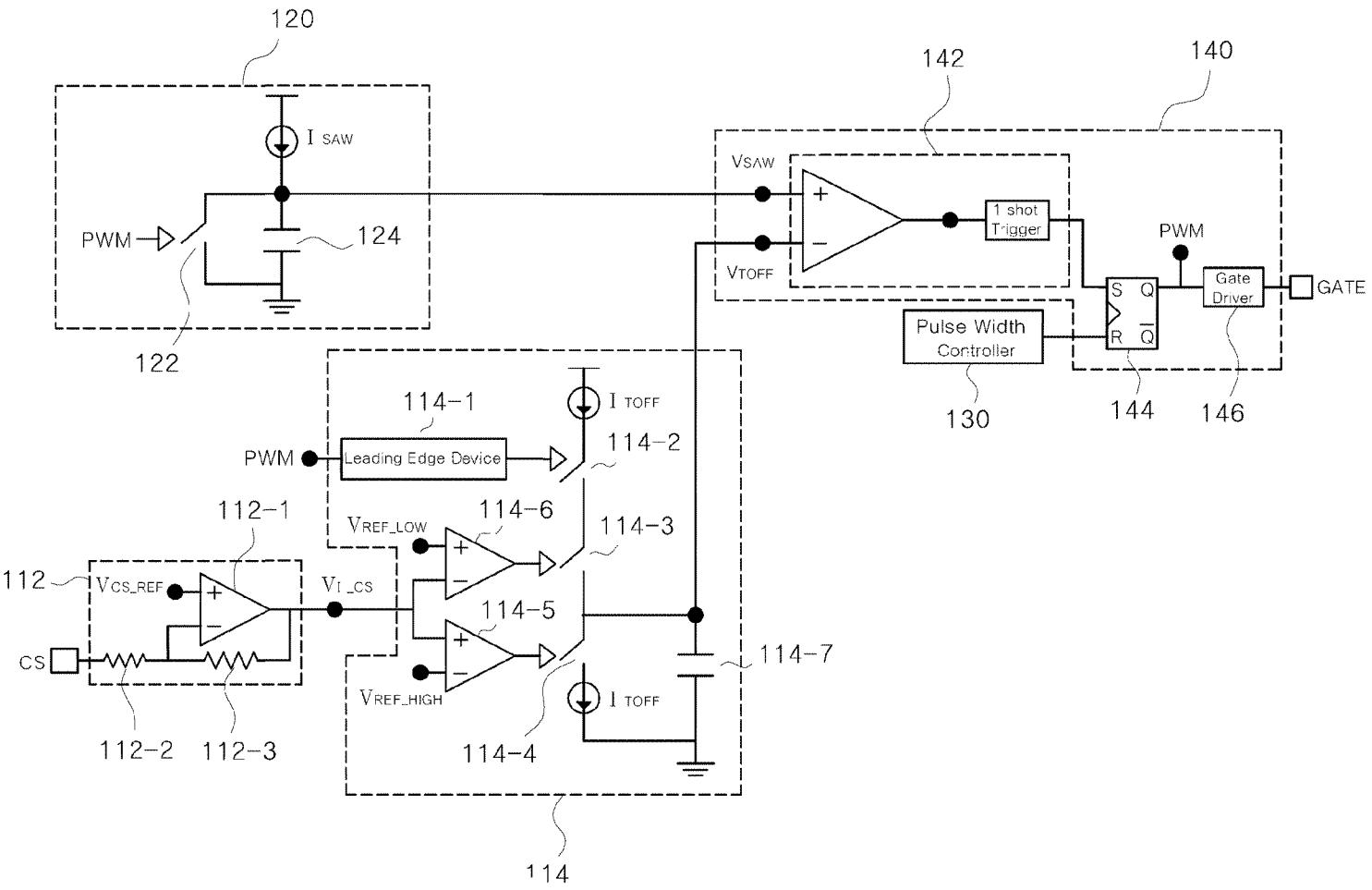
FIG. 3 is a circuit diagram illustrating a trigger circuit in the embodiment of FIG. 1.

FIG. 3 is a circuit diagram illustrating a trigger circuit in the embodiment of FIG. 1.

Referring to the embodiment of FIG. 3, the buffer amplifier 112 may be provided as the inverting amplifier. When the buffer amplifier 112 is provided as the inverting amplifier, the buffer amplifier 112 may include a first comparator 112-1 and first and second resistances 112-2 and 112-3. Also, the buffer amplifier 112 may receive the sensing voltage $V_{CS}$ through the CS pin to invert the sensing voltage $V_{CS}$. In one embodiment, the buffer amplifier 112 may output an inverting voltage $V_{I_CS}$ for detecting the time point at which the sensing voltage $V_{CS}$ reaches first and second certain voltages. Aspects of such first and second certain voltages have been discussed further, above. That is, the off-time controller 110 may compare the output of the buffer amplifier 112 and predetermined first and second reference voltages $V_{REF_HIGH}$, $V_{REF_LOW}$ to detect the time point when the sensing voltage $V_{CS}$ reaches the first and second certain voltages.

For example, the off-time control device 114 may include a leading edge device 114-1, a leading switch 114-2, a charging switch 114-3, a discharging switch 114-4, a high comparator 114-5, a low comparator 114-6 and a first capacitive capacitor 114-7. The first capacitor 114-7 may be charged or discharged based on the sensing voltage and the first and second certain voltages to control the turn-off time of the driving switch 40. More specifically, the off-time control device 114 may detect the time point when the inverting voltage $V_{__CS}$ reaches first and second reference voltages $V_{REF_HIGH}$, $V_{REF_LOW}$ to detect the time point when the sensing voltage $V_{CS}$ reaches the first and second certain voltages. When the inverting voltage $V_{__CS}$ reaches the first or second reference voltages $V_{REF_HIGH}$, $V_{REF_LOW}$, the off-time control device 114 may charge or discharge the first capacitor 114-7 with a first constant current $I_{TOFF}$. Accordingly, the first constant $I_{TOFF}$ may have a constant current level.

In one embodiment, the off-time control voltage $V_{TOFF}$ may be applied to both terminals of the first capacitor 114-7. That is, when the first capacitor 114-7 is charged by the first constant current $I_{TOFF}$, the off-time control voltage $V_{TOFF}$ may linearly increase. When the first capacitor 114-7 is discharged by providing the first constant current $I_{TOFF}$, the off-time control voltage $V_{TOFF}$ may linearly decrease.

Accordingly, the off-time control device 114 may generate and control the off-time control voltage $V_{TOFF}$ based on the inverting voltage $V_{I_CS}$ and first and second reference voltages $V_{REF_HIGH}$, $V_{REF_LOW}$. More specifically, the off-time control device 114 may receive the inverting voltage $V_{I_CS}$ to detect the time point at which the inverting voltage $V_{I_CS}$ reaches first and second reference voltages $V_{REF_HIGH}$, $V_{REF_LOW}$. Accordingly, the leading edge device 114-1 may output a leading edge signal associated with charging the first capacitor 114-7 during the leading edge time from the time point when the driving switch 40 is turned on. The leading edge device 114-1 may provide the leading edge signal to the leading switch 114-2 and as a result, the leading switch 114-2 may be turned on by the leading edge signal.

The low comparator 114-6 may provide the charging switching signal to the charging switch 114-3 when the inverting voltage $V_{I_CS}$ reaches the second reference voltage $V_{REF_LOW}$. When the sensing voltage $V_{CS}$ reaches the first certain voltage, such that the positive voltage is close to the zero voltage value, the inverting voltage $V_{I_CS}$ may reach the second reference voltage $V_{REF_LOW}$. That is, when the sensing voltage $V_{CS}$ reaches the first certain voltage, the low comparator 114-6 may provide the charging switching signal to the charging switch 114-3.

The off-time control device 114 may charge the first capacitor 114-7 with the first constant current $I_{TOFF}$ when the inverting voltage $V_{I_CS}$ reaches the second reference voltage $V_{REF_LOW}$ in the leading edge time from the time point when the driving switch 40 is turned on. That is, the first capacitor 114-7 may be charged by the first constant current $I_{TOFF}$ when the leading switch 114-2 and the charging switch 114-3 are turned on. In this example, the leading edge time may be predetermined for preventing the first capacitor 114-7 from continuously charging during the turn-on section of the driving switch 40. Also, the leading edge time may be predetermined for providing the light emitting diode light apparatus in the boundary conduction mode.

The high comparator 114-5 may provide the discharging switching signal to the discharger 114-4 when the inverting voltage $V_{I_CS}$ reaches the first reference voltage $V_{REF_HIGH}$. When the sensing voltage $V_{CS}$ reaches the second certain voltage, which is a negative voltage being close to the zero voltage, the inverting voltage $V_{I_CS}$ may reach the first reference voltage $V_{REF_HIGH}$. That is, the high comparator 114-5 may provide the discharging switching signal to the discharging switch 114-4 when the sensing voltage $V_{CS}$ reaches the second certain voltage.

For example, the off-time control device 114 may discharge the first capacitor 114-7 using the first constant current $I_{TOFF}$ when the inverting voltage $V_{I_CS}$ reaches the first reference voltage $V_{REF_HIGH}$. That is, the first capacitor 114-7 may be discharged using the first constant current $I_{TOFF}$ when the discharge switch 114-4 is turned on.

Therefore, the off-time controller 110 may charge the first capacitor 114-7 when the sensing voltage $V_{CS}$ is larger than the first certain voltage and may discharge the first capacitor 114-7 when the sensing voltage $V_{CS}$ is smaller than the second certain voltage in the certain time from the time point at which the driving switch 40 is turned on in order to control the off-time control voltage $V_{TOFF}$.

Also, the sawtooth wave voltage generator 120 may include an initialization switch 122 and a second capacitor 124. In one embodiment, the sawtooth wave voltage generator 120 may charge the second capacitor 124 using a second constant current $I_{SAW}$ during the section when the driving switch 40 is turned off. More specifically, when the driving switch 40 is turned off, the initialization switch 122 may be turned off. In such an example, the initialization switch 122 may determine the turn-on time point based on the pulse width modulation signal (PWM). The second capacitor 124 may be charged by the second constant current $I_{SAW}$ when the initialization switch 122 is turned off and may be connected to both terminals of the second capacitor 124. The second current $I_{SAW}$ may have a constant level and the sawtooth wave voltage $V_{SAW}$ may increase linearly. For example, the sawtooth wave voltage $V_{SAW}$ may be provided to the switching trigger 142.

In one embodiment, the sawtooth wave voltage generator 120 may initialize the sawtooth wave voltage $V_{SAW}$ when the driving switch 40 is turned on. More specifically, the second capacitor 124 may be instantaneously discharged when the initialization switch 122 is turned on. When the initialization switch 122 is turned on, the second constant current $I_{SAW}$ may not be charged in the second capacitor 124 to flow into a ground and the sawtooth wave voltage $V_{SAW}$ applied to both terminals of the second capacitor 124 may be initialized.

Figure 4:
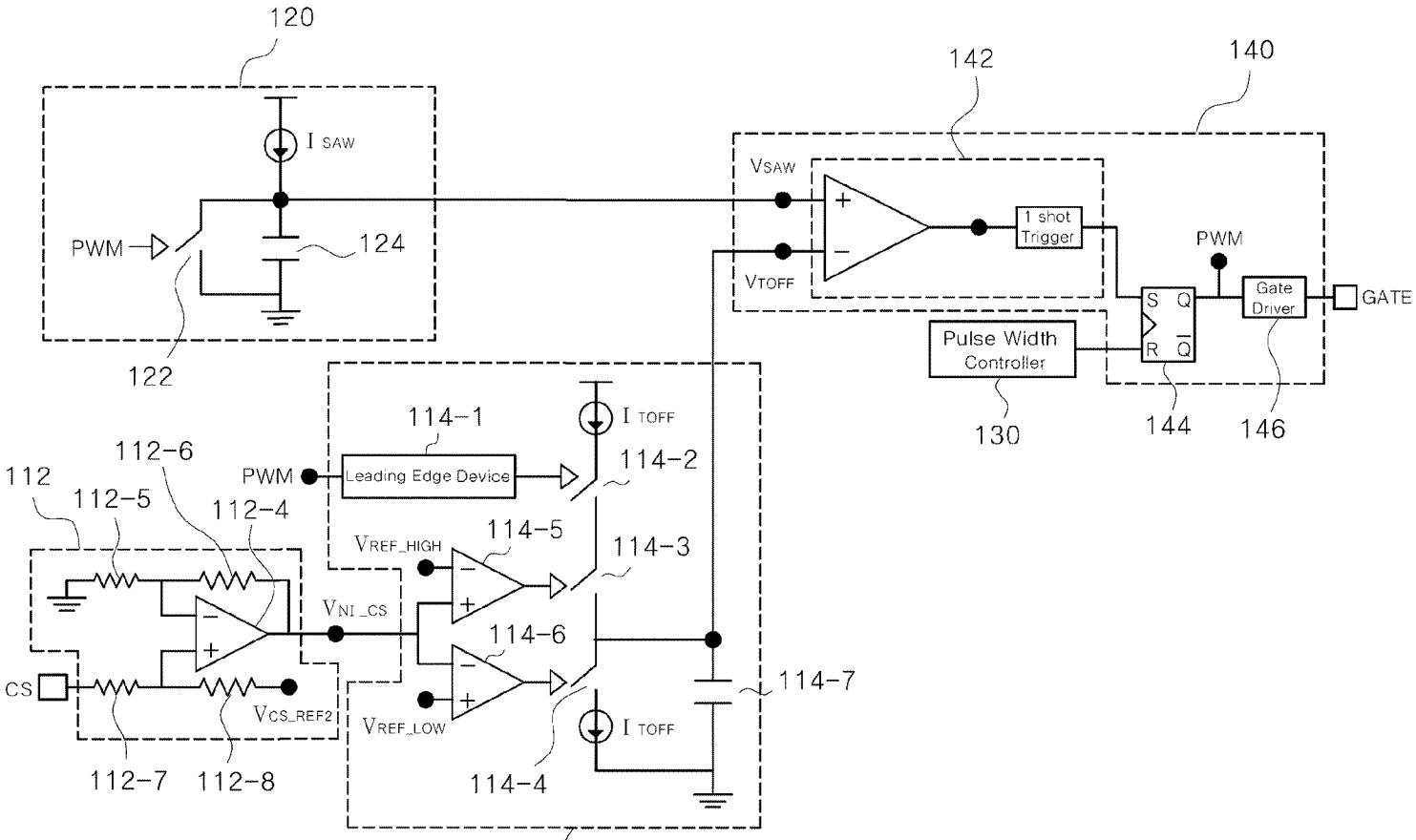
FIG. 4 is a circuit diagram illustrating a trigger circuit provided as a non-inverting amplifier in a buffer amplifier of the trigger circuit in the embodiment of FIG. 1.

FIG. 4 is a circuit diagram illustrating a trigger circuit provided as a non-inverting amplifier in a buffer amplifier of the trigger circuit in FIG. 1.

Referring to FIG. 4, the buffer amplifier 112 may be provided as the non-inverting amplifier. When the buffer amplifier 112 is provided as the non-inverting amplifier, the buffer amplifier 112 may include a second comparator 112-4, and third to sixth resistances 112-5~112-8. The buffer amplifier 112 may receive the sensing voltage $V_{CS}$ through the CS pin to output the non-inverting voltage $V_{NI_CS}$ that has an identical phase with the sensing voltage $V_{CS}$.

In one embodiment, when the sensing voltage $V_{CS}$ reaches the negative voltage, the buffer amplifier 112 may provide a sensing reference voltage $V_{CS_REF2}$ to a negative voltage, that is, Negative $V_{CS}$, to output the non-inverting voltage $V_{NI_CS}$ and a range of the non-inverting voltage $V_{NI_CS}$ may be included in the operation section of the second comparator 112-4.

The off-time control device 114 may generate and control the off-time control voltage $V_{TOFF}$ based on the non-inverting voltage $V_{NI_CS}$ and the first and second reference voltages $V_{REF_HIGH}$, $V_{REF_LOW}$. More specifically, the off-time control device 114 may receive the non-inverting voltage $V_{NI_CS}$ in order to detect the time point at which the non-inverting voltage $V_{NI_CS}$ reaches the first and second reference voltages $V_{REF_HIGH}$, $V_{REF_LOW}$.

In one embodiment, the high comparator 114-5 may provide the charging switching signal to the charging switch 114-3 when the non-inverting voltage $V_{NI_CS}$ reaches the first reference voltage $V_{REF_HIGH}$. When the sensing voltage $V_{CS}$ reaches the first certain voltage, that is, a positive voltage being close to the zero voltage value, the non-inverting voltage $V_{NI_CS}$ may reach the first reference voltage $V_{REF_HIGH}$. That is, the high comparator 114-5 may provide the charging switching signal to the charging switch 114-3 when the sensing voltage $V_{CS}$ reaches the first certain voltage.

The off-time control device 114 may provide charge to the first capacitor 114-7 by providing the first constant current $I_{TOFF}$ in the leading edge time from the time point when the driving switch 40 is turned on until a time at which the non-inverting voltage $V_{NI_CS}$ reaches the first reference voltage $V_{REF_HIGH}$. That is, the first capacitor 114-7 may be charged by the first constant current $I_{TOFF}$ when the leading switch 114-2 and the charging switch 114-3 are turned on.

In one embodiment, the low comparator 114-6 may provide the discharging switching signal to the discharging switch 114-4 when the non-inverting voltage $V_{NI_CS}$ reaches the second reference voltage $V_{REF_LOW}$. When the sensing voltage $V_{CS}$ reaches the second certain voltage, that is, a negative voltage being close to the zero voltage, the non-inverting voltage $V_{NI_CS}$ may reach the second reference voltage $V_{REF_LOW}$. That is, the low comparator 114-6 may provide the discharging switching signal to the discharging switch 114-4 when the sensing voltage $V_{CS}$ reaches the second certain voltage.

The off-time control device 114 may discharge the first capacitor 114-7 through the first constant current $I_{TOFF}$ when the non-inverting voltage $V_{NI_CS}$ reaches the second reference voltage $V_{REF_LOW}$. That is, the first capacitor 114-7 may be discharged through providing the first constant current $I_{TOFF}$ when the discharging switch 114-4 is turned on.

Therefore, the off-time controller 110 may charge the first capacitor 114-7 when the sensing voltage $V_{CS}$ is larger than the first certain voltage and may discharge the first capacitor 114-7 when the sensing voltage $V_{CS}$ is smaller than the second certain voltage in the certain time from the time point when the driving switch 40 is turned on in order to control the off-time control voltage $V_{TOFF}$.

Figure 5:
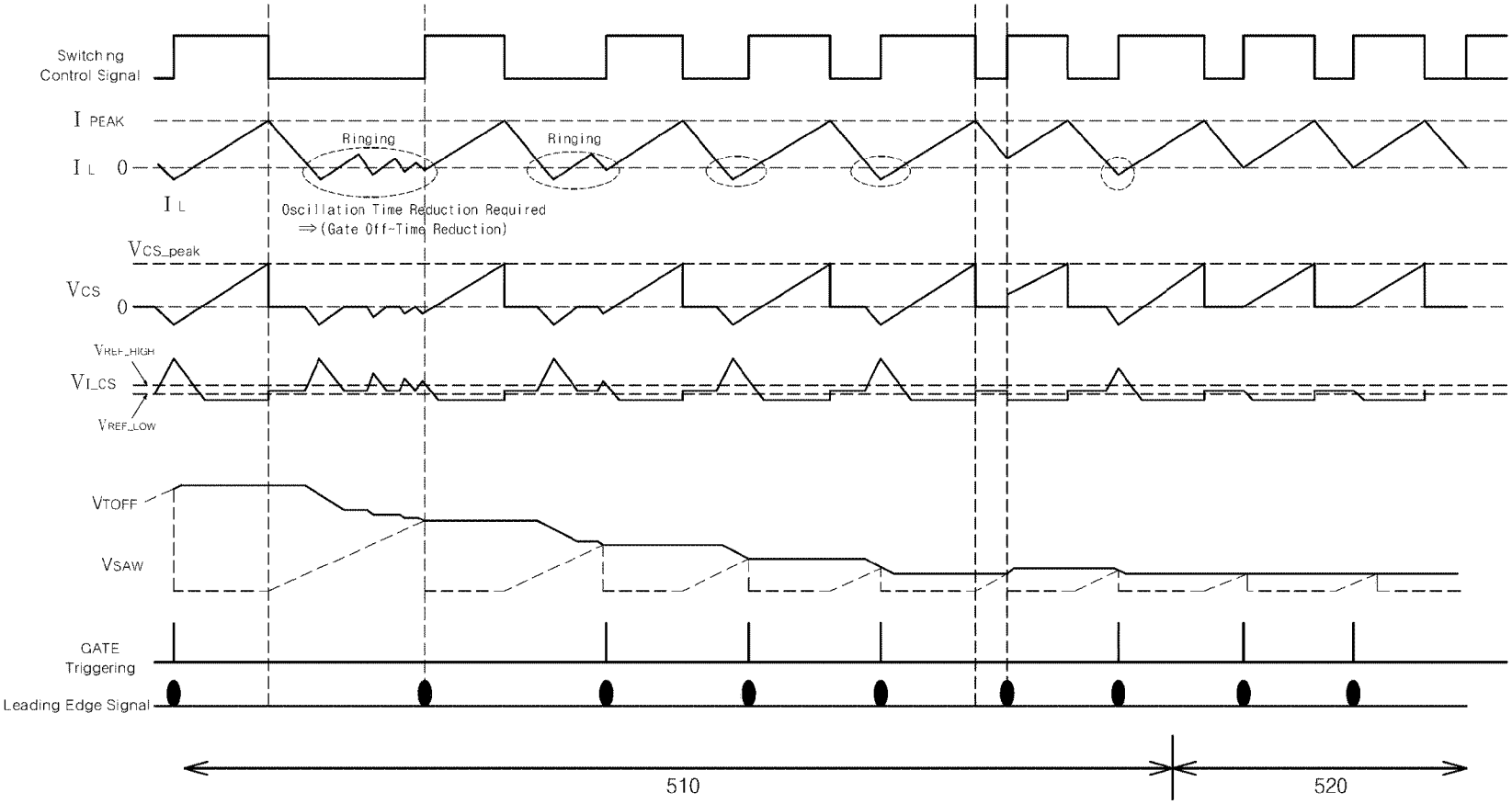
FIG. 5 is a waveform diagram illustrating an operation of a trigger circuit and a light apparatus having the trigger circuit in the embodiment of FIG. 1.

FIG. 5 is a waveform diagram illustrating an operation of a trigger circuit and a light apparatus having the trigger circuit in FIG. 1.

In one embodiment, the driving current $I_L$ may include first and second driving current sections 510, 520. The driving current $I_L$ may generate the ringing in the first driving current section 510. However the ringing may be removed when the boundary conduction mode is provided by the second driving current section 520. Accordingly, the trigger circuit 100 may remove the ringing without using the external high breakdown voltage device.

For example, the driving current $I_L$ may flow through the driving switch 40 when the driving switch 40 is turned on and may increase with a constant slope. In one embodiment, an increasing slope of the driving current $I_L$ may be proportional to a voltage applied to a terminal between the inductor 20 and the LED device 10 and may be inversely proportional to an inductance L of the inductor 20. At the time point at which the driving switch 40 is turned on, a voltage having a value of $V_{IN}-V_{OUT}$ may be applied to the terminal between the inductor 20 and the LED device 10. That is, the slope of increase of the driving current $I_L$ may correspond to $(V_{IN}-V_{OUT})/L$, where L is an inductance.

Whereas, the driving current $I_L$ may flow into the LED device 10 through the diode 30 when the driving switch 40 is turned off. That is, the driving current $I_L$ may flow into the LED device 10 through the diode 30 at a voltage $V_{DIODE}$ applied to both terminals of the diode 30. When a driving switch 40 is turned off, a current charged in the inductor 20 is discharged. As a result, the driving current $I_L$ may decrease with a constant slope.

In one embodiment, a slope of decrease of the driving current $I_L$ may be proportional to the voltage applied to both terminals of the LED device 10 and may also be inversely proportional to the inductance of the inductor 20. In the example of FIG. 1, a voltage of $V_{OUT}$ may be applied to both terminals of the LED device 10. That is, the decrease slope of the driving current $I_L$ may correspond to $-V_{OUT}/L$, where L is the inductance. More specifically, when the driving current $I_L$ reaches the zero value, the voltage applied to both terminals of the inductor 20 may be the zero voltage value. Therefore, the driving current $I_L$ may continuously decrease after reaching the zero current and may reach a minimum peak level at the turn-on time point of the driving switch 40.

In one embodiment, the drain voltage $V_D$ may maintain a constant voltage value of $V_{IN}+V_{DIODE}$ when the driving switch 40 is turned off and the drain current $V_D$ may rapidly decrease when the driving current $I_L$ falls below the certain current or the zero current. When the drain voltage $V_D$ rapidly decreases to be identical to the voltage $V_{IN}-V_{OUT}$ applied to the terminal between the inductor 20 and the LED device 10, such that $V_D=V_{IN}-V_{OUT}$, the driving current $I_L$ flows in the opposite direction and the sensing voltage $V_{CS}$ lowers a negative voltage and the trigger circuit 100 detects that voltage charge to cause triggering in order for the driving switch to be turned-on. When the driving switch 40 is turned on, the driving current $I_L$ may increase with the constant slope.

In one embodiment, because the driving current $I_L$ increases when the driving switch 40 is turned on, the sensing voltage $V_{CS}$ may increase with the constant slope. Because the driving current $I_L$ does not flow into the sensing resistance 50 when the driving switch 40 is turned off, the sensing voltage $V_{CS}$ maintains the zero voltage value. When the driving current $I_L$ is lower the zero current so as to flow in the opposite direction, the sensing voltage $V_{CS}$ may lower the negative voltage. Accordingly, the trigger circuit 100 may detect and turn-on, triggering the driving switch 40.

In one embodiment, when the buffer amplifier 112 is provided as the inverting amplifier, the buffer amplifier 112 may invert the sensing voltage $V_{CS}$ in order to output the inverting voltage $V_{I_CS}$. For example, the phase of the inverting voltage $V_{I_CS}$ may be opposite to the phase of the sensing voltage $V_{CS}$.

In one embodiment, when the sensing voltage $V_{CS}$ reaches the negative voltage, the inverting voltage $V_{I_CS}$ may correspond to the positive voltage, such that $V_{I_CS}=2*V_{CS_REF}-V_{CS}$. However, the sensing voltage $V_{CS}$ may correspond to the positive voltage and the inverting voltage $V_{I_CS}$ may correspond to the zero voltage value when the level of the sensing voltage $V_{CS}$ is larger than the 2*sensing reference voltage, such that $V_{CS}>2*V_{CS_REF}$.

In one embodiment, the off-time control voltage $V_{TOFF}$ may be applied to both terminals of the first capacitor 114-7. When the leading switch 114-2 and the charging switch 114-3 are turned on, the first capacitor 114-7 is charged by using the first constant current $I_{TOFF}$ and the off-time control voltage $V_{TOFF}$ may linearly increase. However, when the discharging switch 114-4 is turned on, the first capacitor 114-7 is discharged by using the first constant current $I_{TOFF}$ and the off-time control voltage $V_{TOFF}$ may linearly increase.

In one embodiment, the sawtooth wave voltage $V_{SAW}$ may be applied to both terminals of the second capacitor 124. When the driving switch 40 is turned off, the initialization switch 122 may be turned off as well and the second capacitor 124 may be charged by using the second constant current $I_{SAW}$ and the sawtooth wave voltage $V_{SAW}$ may linearly increase. However, when the driving switch 40 is turned on, the initialization switch 122 may be turned on and the second capacitor 124 may be instantaneously discharged and sawtooth wave voltage $V_{SAW}$ may be initialized accordingly.

The leading edge device 114-1 may output the leading edge signal associated with the charging of the first capacitor 114-7 during the leading edge time from the time point when the driving switch 40 is turned on. Herein, the leading edge time may be predetermined to have an appropriate value for preventing the first capacitor 114-7 from continuously charging during turn-on section of the driving switch 40.

Figure 6:
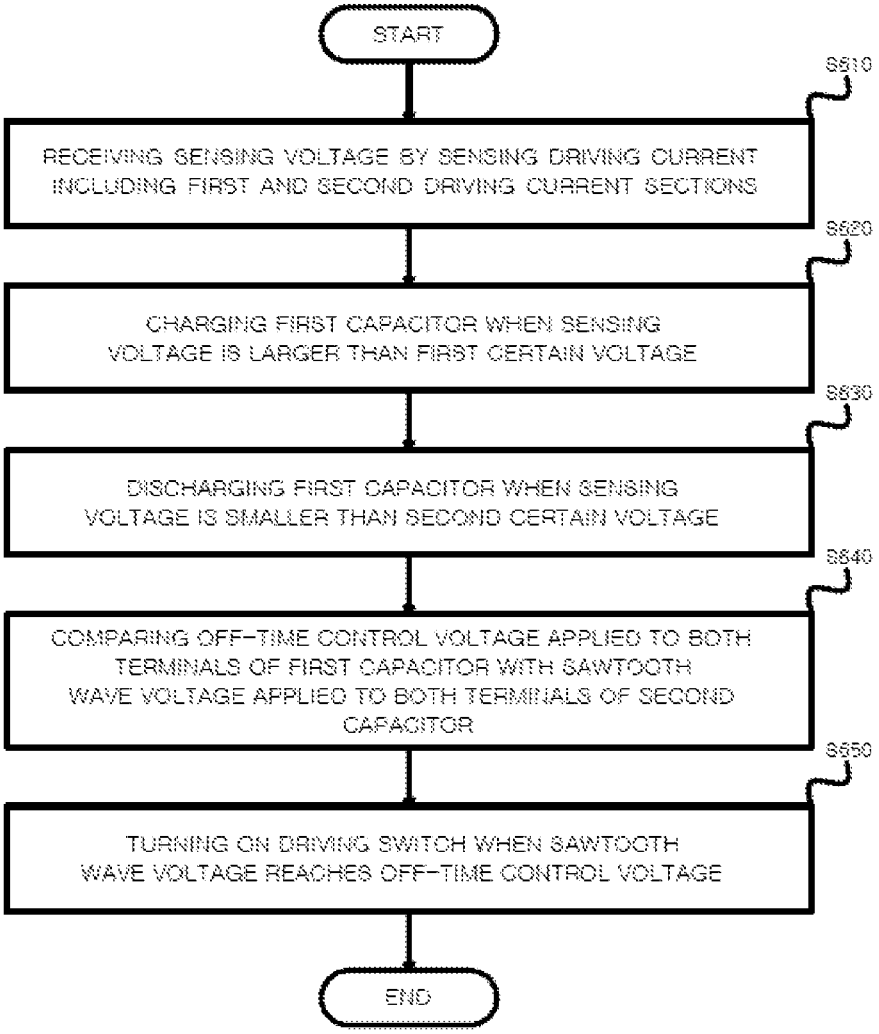
FIG. 6 is a flow chart illustrating a driving method of a trigger circuit and a light apparatus having the circuit in the embodiment of FIG. 1.

FIG. 6 is a flow chart illustrating a driving method of a trigger circuit and a light apparatus having the trigger circuit in FIG. 1. For example, various steps included in the driving method may be performed by the off-time controller 110 and the switching controller 140.

In step S610, the method may receive the sensing voltage $V_{CS}$ sensing the driving current $I_L$ including first and second driving current sections 510, 520. For example, the off-time controller 110 may perform step S610. The sensing voltage $V_{CS}$ may be provided to the off-time controller 110 through the CS pin.

In step S620, the method may charge the first capacitor 114-7 when the sensing voltage $V_{CS}$ is larger than the first certain voltage. For example, the off-time controller 110 may perform step S620. The first capacitor 114-7 may be charged by using the first constant current $I_{TOFF}$ and the off-time control voltage $V_{TOFF}$ may linearly increase accordingly.

In step S630, the method may discharge the first capacitor 114-7 when the sensing voltage $V_{CS}$ is smaller than the second certain voltage. For example, the off-time controller 110 may perform step S630. The first capacitor 114-7 may be discharged by using the first constant current $I_{TOFF}$ and the off-time control voltage $V_{TOFF}$ may linearly decrease accordingly.

In step S640, the method may compare the off-time control voltage $V_{TOFF}$ applied to both terminals of the first capacitor 114-7 with the sawtooth wave voltage $V_{SAW}$ applied to both terminals of the second capacitor 124. For example, the switching controller 140 may perform step S640.

In step S650, the method may turn on the driving switch 40 when the sawtooth wave voltage $V_{SAW}$ reaches the off-time control voltage $V_{TOFF}$. For example, the switching controller 140 may perform step S650.

Accordingly, the trigger circuit and the light apparatus having the trigger circuit may not use the external high breakdown voltage device to control the turning-off time of the driving switch for the driving current so that it corresponds to the zero current value. Also, the trigger circuit 100 and the light apparatus having the trigger circuit 100 may not use the external high breakdown voltage device to provide the boundary conduction mode, and accordingly it is possible to improve the cost competitiveness of such examples.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A trigger circuit, comprising:

an off-time controller configured to receive a sensing voltage by sensing a driving current and to compare the sensing voltage to first and second voltages that are close to a zero voltage value and symmetric to the zero voltage value to control a turn-off time of a driving switch in order for the sensing voltage to correspond to the zero voltage value at a turn-on time point of the driving switch; and a switching controller configured to provide a switching control signal for turning on the driving switch at the turn-on time point of the driving switch.

2. The trigger circuit of claim 1, wherein the off-time controller comprises a first capacitor that is charged or discharged based on the sensing voltage and the first and second voltages to control the turn-off time of the driving switch.

3. The trigger circuit of claim 2, wherein the off-time controller provides a charge switching signal associated with a charge of the first capacitor in response to the sensing voltage being larger than the first voltage.

4. The trigger circuit of claim 2, wherein the off-time controller provides a discharge switching signal associated with a discharge of the first capacitor in response to the sensing voltage being smaller than the second voltage.

5. The trigger circuit of claim 2, wherein the off-time controller provides a leading switching signal associated with a charge of the first capacitor during a time from a time point at which the driving switch is turned on.

6. The trigger circuit of claim 2, wherein the off-time controller discharges the first capacitor using a first constant current during a section in which the sensing voltage is smaller than the second voltage.

7. The trigger circuit of claim 2, wherein the off-time controller charges the first capacitor using a first constant current during a time from the time point that the driving switch is turned on in response the sensing voltage being larger than the first voltage.

8. The trigger circuit of claim 2, further comprising:

a sawtooth wave voltage generator configured to charge a second capacitor with a second constant current during a turn-off section of the operation of the driving switch to generate a sawtooth wave voltage applied to both terminals of the second capacitor.

9. The trigger circuit of claim 8, wherein the sawtooth wave voltage generator initializes the sawtooth wave voltage at the turn-on time point of the driving switch.

10. The trigger circuit of claim 2, wherein the switching controller outputs the switching control signal in response to a sawtooth wave voltage reaching an off-time control voltage applied to both terminals of the first capacitor.

11. The trigger circuit of claim 1, wherein the off-time controller comprises a buffer amplifier in order to control an operating section of the sensing voltage.

12. The trigger circuit of claim 11, wherein the off-time controller compares an output of the buffer amplifier and first and second reference voltages to detect a time point at which the sensing voltage reaches the first and second voltages.

13. The trigger circuit of claim 11, wherein the buffer amplifier is provided using an inverting amplifier or a non-inverting amplifier.

14. The trigger circuit of claim 1, further comprising:

a pulse width controller configured to provide a pulse width control signal at the turn-off time point of the driving switch in order to control a pulse width of a switching control signal for turning on the driving switch.

15. The trigger circuit of claim 1, wherein the first voltage corresponds to a positive voltage that is close to the zero voltage value and the second voltage corresponds to a negative voltage that is close to the zero voltage value.

16. The trigger circuit of claim 1, wherein the switching controller comprises a switching trigger configured to output a switching trigger signal, a storage configured to turn on or turn off the driving switch based on an output variance time point of the switching trigger signal, and a gate driver configured to output the switching control signal for turning on the driving switch.

17. The trigger circuit of claim 16, wherein the storage is provided using an SR latch.

18. The trigger circuit of claim 16, wherein the gate driver outputs the switching control signal through a gate pin.

19. A light emitting diode light apparatus, comprising:

a light emitting diode (LED) device;

an inductor connected in series to the LED device;

a driving switch connected in series to the inductor; and a trigger circuit configured to sense a driving current for driving the LED device in order to control a turn-off time of the driving switch, wherein the trigger circuit comprises an off-time controller configured to receive a sensing voltage by sensing the driving current and to compare the sensing voltage to first and second voltages that are close to a zero voltage value and symmetrical to the zero voltage value to control a turn-off time of the driving switch in order for the sensing voltage to correspond to the zero voltage value at a turn-on time point of the driving switch, and a switching controller configured to provide a switching control signal in order to turn on the driving switch at the turn-on time point of the driving switch.

20. A trigger method, comprising:

receiving a sensing voltage by sensing a driving current;

comparing the sensing voltage to first and second voltages that are close to a zero voltage value and symmetrical to the zero voltage value to charge or discharge a first capacitor in order for the sensing voltage to correspond to the zero voltage value at a turn-on time point of a driving switch;

comparing an off-time control voltage applied to both terminals of the first capacitor to a sawtooth wave voltage applied to both terminals of a second capacitor; and turning on the driving switch in response to the sawtooth wave voltage reaching the off-time control voltage.

* * * * *